US009422043B2

(12) United States Patent
Englebert et al.

(10) Patent No.: US 9,422,043 B2
(45) Date of Patent: Aug. 23, 2016

(54) VESSEL WITH A RIGID WINGSAIL INSTALLATION

(71) Applicant: Propelwind S.A.S., Ploemeur (FR)

(72) Inventors: Patrick Englebert, Mollem (BE); Michel Desjoyeaux, La Foret Fouesnant (FR); Marc van Peteghem, Paris (FR); Vincent Lauriot Prevost, Locmariaquer (FR)

(73) Assignee: PROPELWIND S.A.S., Ploemeur (FR)

( * ) Notice: Subject to any disclaimer, the term of this patent is extended or adjusted under 35 U.S.C. 154(b) by 0 days.

(21) Appl. No.: 14/271,882

(22) Filed: May 7, 2014

(65) Prior Publication Data

US 2015/0033998 A1 Feb. 5, 2015

Related U.S. Application Data

(63) Continuation of application No. PCT/NL2012/050780, filed on Nov. 7, 2012.

(30) Foreign Application Priority Data

Nov. 7, 2011 (NL) ..... 2007729
Jan. 10, 2012 (NL) ..... 2008091

(51) Int. Cl.
*B63B 35/00* (2006.01)
*B63H 9/06* (2006.01)
*B63B 15/00* (2006.01)

(52) U.S. Cl.
CPC ..... *B63H 9/0607* (2013.01); *B63B 15/0083* (2013.01); *B63B 2015/005* (2013.01); *B63H 2009/0621* (2013.01)

(58) Field of Classification Search
CPC ..... B63H 9/0607; B63H 9/00; B63H 9/06; B63H 9/08; B63B 15/0083; B63B 2015/005; B63B 2015/00; B63B 2015/16
USPC ..... 114/39.21, 39.29, 39.32, 102.1, 102.16, 114/102.22, 102.29
See application file for complete search history.

(56) References Cited

U.S. PATENT DOCUMENTS 4,467,741 A * 8/1984 Walker ..... B63H 9/0607 114/102.22
4,473,023 A * 9/1984 Walker ..... B63H 9/0607 114/102.16

(Continued)

FOREIGN PATENT DOCUMENTS

JP 57 095293 A 6/1982
JP 58 012895 A 1/1983

(Continued)

OTHER PUBLICATIONS

Search Report for Netherlands Application No. 2007729.

*Primary Examiner* — Daniel V Venne
(74) *Attorney, Agent, or Firm* — Hoffman & Baron, LLP

(57) ABSTRACT

A vessel provided with at least one rigid wingsail installation with a mast structure and a rigid wingsail.
The mast structure comprises a foot and a mast top which is rotatable about a substantially vertical wingsail rotation axis relative to the vessel. The mast top is provided with a primary tilting assembly.
The rigid wingsail comprises a main panel connected to the mast structure via the primary tilting assembly. This assembly allows tilting of the main panel relative to the mast top about a primary tilt axis.
The rigid wingsail also comprises a top panel which is connected at its lower end to the upper end of the main panel via a secondary tilting assembly. This assembly allows tilting of the top panel relative to the main panel about a secondary tilting axis.

29 Claims, 12 Drawing Sheets

(56) References Cited

U.S. PATENT DOCUMENTS 4,856,449 A * 8/1989 Walker ..... B63H 9/0607 114/102.22
6,431,100 B2 * 8/2002 Abshier ..... B63H 9/0607 114/102.1
7,461,609 B1 * 12/2008 Ott ..... B63H 9/0607 114/102.1
8,281,727 B2 * 10/2012 Gonen ..... B63H 15/0083 114/102.29
2015/0033998 A1 * 2/2015 Englebert ..... B63H 9/0607 114/39.29

FOREIGN PATENT DOCUMENTS

JP 59 018091 A 1/1984
JP 59 184097 A 10/1984

* cited by examiner

Fig. 13a
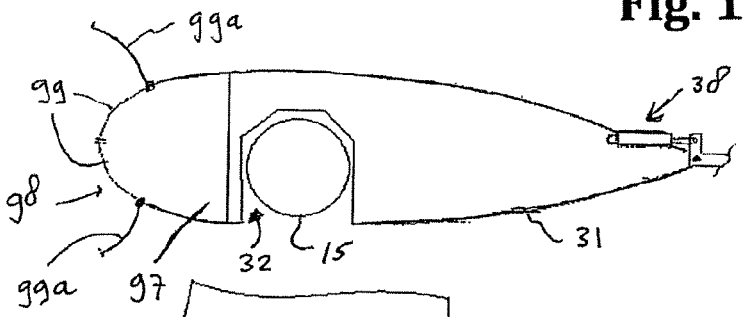
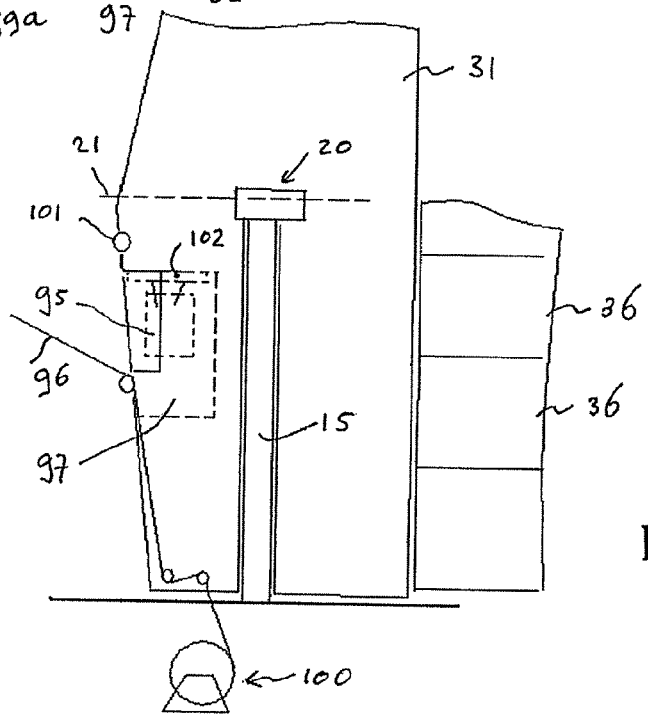
Fig. 13b

VESSEL WITH A RIGID WINGSAIL INSTALLATION

CROSS-REFERENCE TO RELATED APPLICATIONS

This application claims priority under 35 U.S.C. §§120, 365(c) as a continuation of International Application No. PCT/NL2012/050780 filed 7 Nov. 2012, which in turn claims the priority benefit of Netherlands National Patent Application Serial No. 2007729, filed 7 Nov. 2011, and also of Netherlands National Patent Application Serial No. 2008091, filed 10 Jan. 2012. The entire contents and disclosure of each of the aforementioned and/or priority applications is hereby incorporated by reference herein for all purposes.

The present invention relates to a vessel provided with at least one rigid wingsail installation.

In a prior art vessel disclosed in FR 2 609 271 a mast supports a rigid wingsail. The mast has a foot that is secured to the vessel and a mast top. The mast is rotatable about a vertical wingsail rotation axis relative to the vessel to adjust the angle of incidence of the wind. At its mast top the mast is provided with a tilting assembly having a horizontal tilt axis. The rigid wingsail main panel is an airfoil and has a lower end, an upper end, a leading edge, and a trailing edge. The main panel is connected at a position between its lower and upper ends to the mast via the tilting assembly, the tilting assembly allowing for tilting of the main panel relative to the mast top about the tilt axis.

The present invention aims to propose measures to provide improvements over, or at least alternatives for, existing rigid wingsail installations.

The present invention also aims to propose measures that allow for a very large sized wingsail installation, e.g. having a wingsail with a total height of 30 meters or more, e.g. more than 50 meters, e.g. between 50 and 120 meters. Such very large sized wingsails are envisaged for main or auxiliary propulsion of ocean-going commercial vessels, e.g. liquefied gas tankers, product tankers, bulk carriers, car carriers, reefers, cruise liners, ferries, ocean-going yachts, but also for high speed sailing vessels.

The present invention also aims to propose measures that allow for multiple very large sized wingsail installations on a single vessel.

The present invention also aims to propose measures that allow for convenient handling of wingsail installations, in particular large sized wingsail installations.

The present invention also aims to propose measures that allow for a vessel that has both one or more wingsail installations and a liquefied gas fueled propulsion system or at least tanks for holding liquid or gaseous chemical products.

According to a first aspect thereof the invention proposes a vessel provided with at least one rigid wingsail installation, said installation comprising:

a mast structure and a rigid wingsail supported by the mast structure, wherein the mast structure comprises a foot that is secured to the vessel and a mast top, wherein the mast top is rotatable about a substantially vertical wingsail rotation axis relative to the vessel to adjust the angle of incidence of the wind, and wherein the mast top is provided with a primary tilting assembly, wherein the rigid wingsail comprises:

a rigid wingsail main panel having a lower end, an upper end, a leading edge, and a trailing edge, which rigid wingsail main panel is connected at a position intermediate its lower and upper ends to the mast structure via the primary tilting assembly, the primary tilting assembly allowing for tilting of the rigid wingsail main panel relative to the mast top about a primary tilt axis that is non-parallel, preferably substantially perpendicular, to the vertical wingsail rotation axis, a rigid wingsail top panel having a lower end, an upper end, a leading edge, and a trailing edge, which rigid wingsail top panel is connected at its lower end to the upper end of the rigid wingsail main panel via a secondary tilting assembly, the secondary tilting assembly allowing for tilting of the rigid wingsail top panel relative to the rigid wingsail main panel about a secondary tilt axis that is non-parallel, preferably substantially perpendicular, to the vertical wingsail rotation axis, more preferably parallel to the primary tilt axis.

The first aspect of the invention is based on the insight that—in particular for a very large sized wingsail installation—it is in many situations advantageous that the installation allows both for tilting of the main panel via the primary tilting assembly on the mast top and for tilting of the top panel with respect to the main panel.

For sailing with the installation it is envisaged that the wingsail is maintained in a substantially vertically erected sailing position with respect to the mast structure, with the top panel and main panel aligned and generally forming a contiguous rigid airfoil body.

In a preferred embodiment the mast structure and the rigid wingsail are unstayed, so without stays to keep the mast structure and the wingsail in vertically erect position. The absence of stays facilitates tilting of the wingsail and wingsail panels as will be discussed below in more detail.

It is preferred for the main panel to be provided with an elongated mast structure receiving recess wherein the mast structure is received when the main panel is in its vertically erected sailing position. The recess may be left open at the entrance side during sailing, but if desired a movable cover could be provided to close the entrance side and to enhance the streamline of the airfoil body of the main panel.

In a preferred embodiment the mast top is able to rotate a full 360°, e.g. to allow for weathervaning in excessive wind conditions. Different exemplary embodiments of rotatable mast tops, possibly as part of a fully rotatable mast structure, are discussed below.

As is preferred the wingsail main and top panels are embodied as rigid, preferably symmetrical, airfoil section panels, e.g. having a box structure with frame members, e.g. with horizontal airfoil frame members at various heights and vertical frame members, said frame members supporting a hard outer skin.

The wingsail main panel and/or top panel may include rigid, non-mobile flap portions at their trailing end, e.g. to be extended rearwards further by one or more pivotable trailing flaps.

In an embodiment one or more wingsail locking devices are provided to lock the wingsail in its vertically erected sailing position with respect to the mast structure. This may e.g. include one or more hydraulic actuated latch devices, e.g. near the lower end of the mast and/or of the main panel, and/or near or integrated in the primary tilting assembly.

For example the wingsail installation may be adapted to bring the wingsail in a docking position, wherein the main panel is substantially horizontal and the top panel is oriented downwards, preferably substantially vertical.

Bringing the wingsail in such a docking position may e.g. be done when entering a port, during mooring, or e.g. when inspection or maintenance is to be performed on the wingsail installation. For example one can envisage that equipment is arranged at the top of the top panel of the wingsail, e.g. communications equipment, radar, signaling lights, etc. The ability to bring the wingsail in this docking position allows for easier access to said equipment by maintenance crew members.

One can also envisage that the top panel is temporarily tilted—with the main panel remaining in sailing position—to temporarily reduce the height of the wingsail, e.g. when passing under a bridge, e.g. to meet Panamax height.

In an embodiment the vessel comprises a docking position securing assembly that is adapted to engage on the top panel in its downward oriented docking position, with the main panel substantially horizontal, and to secure said top panel relative to the vessel. The securing of the top panel avoids any risk of undesirable wingsail motion, e.g. sea-state induced or wind force induced, e.g. allowing for safe working conditions for maintenance crew members.

A securing assembly may for example include a stationary framework, e.g. with one or more fenders, against which a portion of the top panel can be brought to bear, or mobile or flexible securing devices, e.g. with (hydraulically) actuated securing arms, cables, straps, etc.

In an embodiment the docking position securing assembly comprises one or more work platforms accessible by crew members, e.g. to perform maintenance on equipment arranged on the top panel, e.g. on the upper end of the top panel.

In a practical embodiment the first tilt axis is located in a region halfway the height of the main panel, e.g. between 40 and 60% of the height of the main panel.

In a practical embodiment the first tilt axis is arranged at approximately ⅓ of the total height of the wingsail and the second tilt axis at about ⅔ of the total height of the wingsail.

In a practical embodiment the total height of the wingsail above the corresponding deck portion is at least 30 meters, preferably more than 50 meters, possibly between 75 and 120 meters.

In a practical embodiment the height of the mast structure above the corresponding deck portion is at least 10 meters, possibly between 25 and 40 meters.

In a practical embodiment the mast is a tubular mast which may have a diameter between 2 and 4 meters.

A tubular mast may be but need not be circular in cross-section, e.g. the mast can be octagonal, square, rectangular, etc.

It is envisaged that in a practical embodiment the wingsail may have a weight of 30 tonnes or more, e.g. between 300 and 600 tonnes.

It is envisaged that the main panel may have a greatest thickness—at right angles to the main surface of the main panel—of more than 1 meter, e.g. between 2 and 5 meters.

It is preferred for the wingsail rotation axis to be arranged in a non-variable vertical orientation on the vessel. However, for example, a slightly inclined wingsail rotation axis is also well possible, e.g. within a range of 15° from vertical.

To allow for controlled tilting of the wingsail about the first tilt axis it is preferred that the primary tilting assembly is associated with one or more power drive motors arranged between the mast top and the main panel, e.g. one or more hydraulic jacks, to provide tilting force for performing the tilting of the wingsail about the primary tilt axis.

To allow for controlled tilting of the top panel about the second tilt axis it is preferred that the secondary tilting assembly is associated with one or more power drive motors arranged between the main panel and the top panel, e.g. one or more hydraulic jacks, to provide tilting force for performing the tilting of the top panel about the secondary tilt axis.

In a practical embodiment a hydraulic group is provided including a motor driven hydraulic pump, a reservoir for hydraulic fluid, and a hydraulic circuit, said hydraulic group being connected to one or more hydraulic jacks arranged between the mast top and the main panel, and/or between the main panel and the top panel. The hydraulic group may be arranged at the top end of the mast, within the mast, e.g. within the foot (for example when the foot is rotatable as part of a rotatable mast structure), or—as is also possible—near the foot of the mast in an associated room of the vessel.

In a practical embodiment each tilting assembly is associated with a row of multiple hydraulic jacks arranged at a distance from the respective tilt axis, e.g. hydraulic jacks engaging on a balance arm of the main panel.

In a practical embodiment each tilting assembly comprises a tilting shaft, e.g. secured to the mast top or to the main panel at its upper end. The tiltable main panel or top panel can e.g. be connected to said shaft via one or more eye members through which said shaft extends.

In a practical embodiment the first and/or second tilting shaft is arranged parallel to and horizontally offset from a vertical midplane of the wingsail, allowing for the positioning of one or more power drive motors, e.g. hydraulic jacks, within the contour of the wingsail next to the offset arranged tilting shaft.

In a practical embodiment the first and/or second tilting shaft is offset horizontally such that a portion of the shaft extends outside the contour of the main panel or top panel, preferably a bulbous, e.g. streamlined, cover being provided on said panel to cover the extending portion of the tilting shaft.

In a practical embodiment the tilt angle of the main panel is limited between a vertical sailing position of the main panel and a substantially horizontal position of the main panel, e.g. a tilt range of at most 100° in one direction.

In a practical embodiment the tilt angle of the top panel with respect to the main panel is limited between an aligned sailing position of the top panel and a substantially perpendicularly angled position with respect to the main panel, e.g. a tilt range of at most 100° in one direction.

In an embodiment at least one tilting assembly of the wingsail, preferably each tilting assembly, comprises one or more locking devices, e.g. hydraulically operated locking members, e.g. pins, that lock the panels of the wingsail at least in the sailing position so as to form a contiguous wingsail. In a variant one or more locking device are provided to lock the panels of the wingsail in docking position of the wingsail so as to inhibit tilting about a tilting axis.

It is preferred for the secondary tilt axis to be parallel to the primary tilt axis, and most preferably perpendicular to the mast rotation axis, but another arrangement is also possible, e.g. at an angle between 60 and 120° with respect b the vertical wingsail rotation axis. This will clearly impact the position of the top panel in downward orientation thereof with respect to the vessel.

The first aspect of the invention is particularly advantageous on a vessel that has at least a first and a second wingsail installation, wherein the mast structures of the wingsail installations are spaced apart by a mast spacing distance and it is envisaged that for docking the wingsails the one wingsail is tilted so as to be lying with its main panel extending towards the other mast structure. For example the mast structures are located on a longitudinal axis of the vessel at a mast spacing distance from one another and the wingsails are brought in a docking position with their main panels extending in longitudinal direction.

The first aspect of the invention allows for a vessel design wherein the total height of each wingsail measured from the lower end of the main panel to the top end of the wingsail is greater than the mast spacing distance.

For docking the wingsails one can envisage that a wingsail, with its top panel still aligned with the corresponding main panel, is brought into an overlapping position with the other wingsail, so that one wingsail lies with a top portion thereof above or below the lower portion of the other wingsail.

In a preferred embodiment of the wingsails and associated preferred docking position, the top panel is folded downward relative to the substantially horizontally arranged main panel, with the respective wingsail parts being dimensioned such so that there is no overlap between the wingsails in the docking position.

In an embodiment the rigid wing sail may comprise a bottom panel having a lower end, an upper end, a leading edge, and a trailing edge, which rigid wingsail bottom panel is connected at its upper end to the lower end of the rigid sail main panel via a tertiary tilting assembly, the tertiary tilting assembly allowing for tilting of the rigid wingsail bottom panel relative to the rigid wingsail main panel about a tertiary tilting axis that is non-parallel, preferably substantially perpendicular, to the vertical wingsail rotation axis, more preferably parallel to the primary tilt axis.

This embodiment e.g. can allow for an even closer spacing between the mast structures without overlapping of the wing sails in docking situation.

This embodiment may also facilitate access to the lower end of the wingsail by maintenance crew.

In general the possibility to fold the wingsail at the first tilt axis and/or the third tilt axis may also be used to diminish the horizontal extension of the wingsail in docking situation, e.g. to reduce the shadow over one or more decks of the vessel. This may e.g. be of relevance for a cruise liner. The same effect could also be relevant to reduce the horizontal extension when the main panel would otherwise extend beyond the bow or the stern of the vessel, e.g. of relevance in port, in locks, etc. The same effect could also be relevant to allow for clear deck space for a helicopter pad, funnel structure, etc.

It is envisaged that the tilting of very large sized wingsails, which may have enormous weight, is facilitated in an embodiment wherein the rigid wing sail is provided with one or more internally arranged tilting procedure ballast water balancing tanks. It is then envisaged that the installation comprises a wingsail balancing system comprising one or more water pumps and a water circuit connecting the pump to said one or more balancing tanks allowing to control and vary the amount of water in said balancing tanks, in particular during tilting of the main panel about the primary tilting axis. The water balancing generally will allow to bring the center of gravity of the tilting wingsail close to the tilt axis. For example when the portion of the wingsail above or a portion below the first tilt axis is heavier than the portion of the wingsail opposite the tilt axis, one could fill one or more balancing tanks in the lightest portion to effect a shift of the center of gravity towards the first tilt axis and thereby reduce the effort required to tilt the wingsail in a controlled manner.

The water balancing system may in an embodiment also be used to stabilize the wingsail in its vertical sailing position, e.g. prior to the engagement of one or more locking devices that lock the wingsail in said position relative to the mast structure.

In an alternative to water ballasting of the wingsail to facilitate the tilting procedure one or more mobile ballast blocks could be provided within the contour of the wingsail main panel.

It is envisaged that the motion of the one or more wingsails of a vessel between its erected sailing position and one or more docking positions is effected by a suitable computer controlled tilting system that includes power motors for each tilt axis, said tilting system comprising a memory that stores one or more preprogrammed tilting procedures.

As explained above the invention is applicable to very large size wingsails, where the total height may lie between 30 and 120 meters. This will mean that—when present—equipment like the power motors at the first and second tilt axis, and other equipment like actuators for pivoting wingsail trailing flap elements are very high above the deck of the vessel.

In order to facilitate access to such equipment as well as allow for inspection of the wingsail, possibly also allow for access to an elevated view bridge, e.g. for cruise liner passengers, it is envisaged in an embodiment that the mast structure is provided with a first personnel or material elevator comprising an elevator cage and a motorized hoisting device for said elevator case, said first elevator extending over at least a major part of the height of the mast.

One can also envisage that the wing sail main panel is provided with a second personnel or material elevator comprising an elevator cage and a motorized hoisting device for said elevator case, said elevator extending over at least a major part of the height of the main panel.

One can also envisage that the top panel is provided with a third personnel or material elevator comprising an elevator cage and a motorized hoisting device for said elevator case, said elevator extending over at least a major part of the height of the top panel.

The mast structure and/or wingsail main and top panels can be provided, in addition to an elevator or as alternative therefore, with stairs or ladders.

In a preferred embodiment both the main panel and the top panel are provided at their rear end with at least one wingsail trailing flap element, said flap element being pivotally connected to the wingsail main panel or top panel via a pivot assembly allowing to vary the angle of the trailing flap element, e.g. about a substantially vertical pivot axis.

In a preferred embodiment each trailing flap element is an airfoil sectioned flap, e.g. with horizontal frame members and vertical frame members, said frame members supporting a hard skin.

Preferably multiple, independently pivotable trailing flap elements are provided along the rear of the main panel and top panel, each having one or more associated power actuators, e.g. one or more hydraulic jacks, to perform the pivoting of each flap into the desired position.

In an embodiment the pivot axis of the trailing flap element lies within the contour of the main panel or top panel, whereas in another embodiment this pivot axis lies at the very trailing edge of the main or top panel or even further to the rear.

Preferably each trailing flap is embodied as an airfoil body.

In an embodiment the wingsail may comprises one or more leading flap element provided at the front of the main panel and/or top panel, said leading flap elements each being pivotally connected to the wingsail main panel or top panel via a pivot assembly allowing to vary the angle of the leading flap element, e.g. about a substantially vertical pivot axis.

In an embodiment the wingsail is provided with photovoltaic cells to produce electrical power, e.g. such cells being arranged at least on the trailing flap elements.

In an embodiment wherein photovoltaic cells are arranged on the trailing flap elements, one can envisage that—in a docking position of the wingsail—the installation allows for pivoting of a trailing flap element in order to optimize the production of electrical power with the photovoltaic cells on said flap element.

In a preferred embodiment the mast structure comprises a singular column structure, e.g. as a tubular mast, preferably a tubular mast with a substantially closed outer wall, or a lattice structure column. For very large sized wingsails as envisaged herein the column may have a diameter of multiple meters, e.g. between 2 and 4 meters. The mast may be circular in cross-section, but other shapes are also possible, e.g. square, rectangular, oval, etc.

In a less preferred embodiment a mast structure may comprise e.g. two columns side by side on a common rotary base, the primary tilting assembly being located at the top ends of the two columns.

In a possible embodiment the singular column structure is embodied as a rotatable column whereof the foot is rotatably connected to the vessel so as to allow for rotation about the mast rotation axis, and whereof the top end is provided with the primary tilting assembly.

In a more practical embodiment for very tall masts, the singular column structure comprises a fixed column whereof the foot is fixed to the vessel, and a top end member that is rotatably mounted on the fixed column so as to allow for rotation about the mast rotation axis. Herein the top end member is provided with the primary tilting assembly.

In an embodiment the mast structure is telescopic, thereby allowing to vary the distance between the wingsail and the deck of the vessel. This feature can e.g. be put to use with the wingsail in docking position, e.g. to lower the horizontally oriented main panel to reduce the height of the vessel. It can e.g. also be used to change the distance between a downward oriented top panel and the deck or securing assembly. It can e.g. also be used to place the main panel at a more inclined orientation when in its docking position, instead of a more or less horizontal orientation. In an extreme the lower end of the main panel could be brought onto or close by a deck of the vessel, so that the main panel extends as an upward ramp. This may e.g. be of use when harvesting solar energy with photovoltaic cells on the wingsail.

In a practical embodiment the rotatable top end member comprises a tubular part that is positioned over the fixed column, e.g. the tubular part has a length of at least 10 meters, one or more bearings being provided between the fixed column and the tubular part.

In a practical embodiment a mast structure rotation drive is provided comprising one or more motors, said drive being adapted to adjust and maintain the desired angular position of the mast structure about the mast rotation axis.

In an embodiment the mast structure rotation drive is embodied to have a weathervaning mode, wherein the wingsail is allowed to weathervane, e.g. in excessive wind conditions.

In an embodiment the vessel is a catamaran vessel having twin hulls.

In an embodiment the vessel is an ocean-going cruise liner vessel having multiple passenger cabins.

In an embodiment the vessel not only has a rigid wingsail installation, but also an electrically power propulsion system, the wingsail being provided with photovoltaic cells generating energy for e.g. the propulsion system.

In an embodiment the vessel not only has a rigid wingsail installation but also a liquefied gas propulsion system, e.g. liquefied natural gas (LNG) or LPG, said system including one or more storage tanks for said liquefied gas and one or more combustion motors fueled by said liquefied gas. Such propulsion is cleaner than commonly used bunker fuels in the shipping industry.

In an embodiment a vent line for the venting of gas is provided, which vent line has a section that extends through or along the mast of the wingsail installation. The vent line may have an exhaust opening at the mast top or is eventually connected via a pivotal or flexible connector at the primary tilting assembly to a further vent line section that extends upward through or along said rigid wingsail to a vent line outlet. This allows for reliable and safe venting of liquefied gas in an emergency or when required for operation. If desired a secondary vent mast which may be provided remote from the wingsail mast, e.g. having an exhaust at a location higher that the mast top, e.g. for use when the wingsail is in docking position.

In an embodiment the vessel has one or more storage tanks for gas (e.g. liquefied gas) or chemical products, the vessel having a vent line for venting gaseous products, e.g. evaporated gas or chemical products, as indicated in the above paragraph.

A second aspect of the invention relates to a vessel provided with at least one rigid wingsail installation, said installation comprising:

a mast structure and a rigid wingsail supported by the mast structure, wherein the mast structure comprises a foot that is secured to the vessel and a mast top, wherein the mast top is rotatable about a substantially vertical wingsail rotation axis relative to the vessel to adjust the angle of incidence of the wind, and wherein the mast top is provided with a primary tilting assembly, wherein the rigid wingsail comprises:

a rigid wingsail main panel having a lower end, an upper end, a leading edge, and a trailing edge, which rigid wingsail main panel is connected at a position intermediate its lower and upper ends to the mast structure via the primary tilting assembly, the primary tilting assembly allowing for tilting of the rigid wingsail main panel relative to the mast top about a primary tilt axis that is non-parallel, preferably substantially perpendicular, to the vertical wingsail rotation axis, wherein the vessel has at least a first and a second wingsail installation, the mast structures of said wingsail installations being spaced apart by a mast spacing distance, wherein the total height of each wingsail measured from the lower end of the main panel to the top end of the wingsail is greater than the mast spacing distance, and wherein the installation is adapted to bring each wingsail in a docking position wherein the main panel is substantially horizontal, so that the second wingsail lies with a top portion thereof above or below the lower portion of the first wingsail.

As explained with reference to the first aspect of the invention, this second aspect of the invention allows for relatively reduced spacing of the mast structure in combination with large sized wingsails that are effectively brought in this docking position when desired.

A third aspect of the present invention relates to a vessel provided with at least one rigid wingsail installation, said installation comprising:

a mast structure and a rigid wingsail supported by the mast structure, wherein the mast structure comprises a foot that is secured to the vessel and a mast top, wherein the mast top is rotatable about a substantially vertical wingsail rotation axis relative to the vessel to adjust the angle of incidence of the wind, and wherein the mast top is provided with a primary tilting assembly, wherein the rigid wingsail comprises:

a rigid wingsail main panel having a lower end, an upper end, a leading edge, and a trailing edge, which rigid wingsail main panel is connected at a position intermediate its lower and upper ends to the mast structure via the primary tilting assembly, the primary tilting assembly allowing for tilting of the rigid wingsail main panel relative to the mast top about a primary tilt axis that is non-parallel, preferably substantially perpendicular, to the vertical wingsail rotation axis, wherein—for tilting of the main panel about the primary tilting axis—the installation comprises one or more hydraulic jacks between the mast top and the main panel, as well as a hydraulic group including a motor driven hydraulic pump, a reservoir for hydraulic fluid, and a hydraulic circuit connected to said one or more hydraulic jacks.

As explained with reference to the first aspect of the invention, this third aspect of the invention allows for efficient, safe and controlled tilting of the main panel (and all other wingsail elements that perform the same tilting motion).

A fourth aspect of the present invention relates to a vessel provided with at least one rigid wingsail installation, said installation comprising:

a mast structure and a rigid wingsail supported by the mast structure, wherein the mast structure comprises a foot that is secured to the vessel and a mast top, wherein the mast top is rotatable about a substantially vertical wingsail rotation axis relative to the vessel to adjust the angle of incidence of the wind, and wherein the mast top is provided with a primary tilting assembly, wherein the rigid wingsail comprises:

a rigid wingsail main panel having a lower end, an upper end, a leading edge, and a trailing edge, which rigid wingsail main panel is connected at a position intermediate its lower and upper ends to the mast structure via the primary tilting assembly, the primary tilting assembly allowing for tilting of the rigid wingsail main panel relative to the mast top about a primary tilt axis that is non-parallel, preferably substantially perpendicular, to the vertical wingsail rotation axis, wherein the rigid wing sail is provided with one or more internally arranged tilting procedure ballast water balancing tanks, wherein the installation comprises a wingsail balancing system comprising one or more water pumps and a water circuit connecting to said one or more balancing tanks allowing to control and vary the amount of water in said balancing tanks, in particular during tilting of the main panel about the primary tilting axis.

As explained with reference to the first aspect of the invention, this fourth aspect of the invention allows for efficient, safe and controlled tilting of the main panel (and all other wingsail elements that perform the same tilting motion).

A fifth aspect of the present invention relates to a vessel provided with at least one rigid wingsail installation, said installation comprising:

a mast structure and a rigid wingsail supported by the mast structure, wherein the mast structure comprises a foot that is secured to the vessel and a mast top, wherein the mast top is rotatable about a substantially vertical wingsail rotation axis relative to the vessel to adjust the angle of incidence of the wind, and wherein the mast top is provided with a primary tilting assembly, wherein the rigid wingsail comprises:

a rigid wingsail main panel having a lower end, an upper end, a leading edge, and a trailing edge, which rigid wingsail main panel is connected at a position intermediate its lower and upper ends to the mast structure via the primary tilting assembly, the primary tilting assembly allowing for tilting of the rigid wingsail main panel relative to the mast top about a primary tilt axis that is non-parallel, preferably substantially perpendicular, to the vertical wingsail rotation axis, and wherein the wingsail optionally comprises a rigid wingsail top panel having a lower end, an upper end, a leading edge, and a trailing edge, which rigid wingsail top panel is connected at its lower end to the upper end of the rigid sail main panel via a secondary tilting assembly, the secondary tilting assembly allowing for tilting of the rigid wingsail top panel relative to the rigid wingsail main panel about a secondary tilting axis that is non-parallel, preferably substantially perpendicular, to the vertical wingsail rotation axis, more preferably parallel to the primary tilt axis, and wherein the mast structure is provided with a first personnel or material elevator comprising an elevator cage and a motorized hoisting device for said elevator case, said first elevator extending over at least a major part of the height of the mast, and wherein, optionally, the wing sail main panel is provided with a second personnel or material elevator comprising an elevator cage and a motorized hoisting device for said elevator case, said elevator extending over at least a major part of the height of the main panel, and wherein, optionally, the top panel is provided with a third personnel or material elevator comprising an elevator cage and a motorized hoisting device for said elevator case, said elevator extending over at least a major part of the height of the top panel.

As explained with reference to the first aspect of the invention, this fifth aspect of the invention allows for efficient and safe access of crew members and/or passengers to elevated locations in the wingsail and the mast, e.g. to a view bridge in the main panel.

A sixth aspect of the present invention relates to a vessel provided with at least one rigid wingsail installation, said installation comprising:

a mast structure and a rigid wingsail supported by the mast structure, wherein the mast structure comprises a foot that is secured to the vessel and a mast top, wherein the mast top is rotatable about a substantially vertical wingsail rotation axis relative to the vessel to adjust the angle of incidence of the wind, and wherein the mast top is provided with a primary tilting assembly, wherein the rigid wingsail comprises:

a rigid wingsail main panel having a lower end, an upper end, a leading edge, and a trailing edge, which rigid wingsail main panel is connected at a position intermediate its lower and upper ends to the mast structure via the primary tilting assembly, the primary tilting assembly allowing for tilting of the rigid wingsail main panel relative to the mast top about a primary tilt axis that is non-parallel, preferably substantially perpendicular, to the vertical wingsail rotation axis, at least one wingsail trailing flap element, said flap element being pivotally connected to the rigid wingsail main panel via a pivot assembly allowing to vary the angle of incidence of the flap element, wherein the installation is adapted to bring the wingsail in a docking position wherein the main panel is substantially horizontal, and wherein at least the wingsail trailing flap element of the wingsail is provided with photovoltaic cells to produce electrical power, and wherein the installation is adapted to allow for pivoting of the flap element whilst the wingsail is in its docking position in order to optimize the production of electrical power with the photovoltaic cells on said flap element.

As explained with reference to the first aspect of the invention, this sixth aspect of the invention allows for optimal harvesting of sunlight by means of the photovoltaic cells on the wingsail flap elements.

A seventh aspect of the present invention relates to a vessel provided with at least one rigid wingsail installation, said installation comprising:

a mast structure and a rigid wingsail supported by the mast structure, wherein the mast structure comprises a foot that is secured to the vessel and a mast top, wherein the mast top is rotatable about a substantially vertical wingsail rotation axis relative to the vessel to adjust the angle of incidence of the wind, and wherein the mast top is provided with a primary tilting assembly, wherein the rigid wingsail comprises:

a rigid wingsail main panel having a lower end, an upper end, a leading edge, and a trailing edge, which rigid wingsail main panel is connected at a position intermediate its lower and upper ends to the mast structure via the primary tilting assembly, the primary tilting assembly allowing for tilting of the rigid wingsail main panel relative to the mast top about a primary tilt axis that is non-parallel, preferably substantially perpendicular, to the vertical wingsail rotation axis, wherein said vessel comprises one or more storage tanks for gas, e.g. liquefied gas or other liquid or gaseous chemical products, wherein possibly said vessel comprises a liquefied gas propulsion system, e.g. on LNG or LPG, said propulsion system including one or more combustion motors fueled by said liquefied gas, wherein a vent line for the venting of liquefied or evaporated gas is provided, which vent line has a section that extends through or along said mast structure and is eventually connected via a pivotal or flexible connector at the primary tilting assembly to a possible further section that extends upward through or along said rigid wingsail to a vent line outlet.

As explained with reference to the first aspect of the invention, this seventh aspect of the invention allows for efficient and safe venting of liquefied or evaporated gas or chemicals in an emergency or when required for operation.

An eighth aspect of the present invention relates to a vessel provided with at least one rigid wingsail installation, said installation comprising:

a mast structure comprising a foot that is secured to the vessel and a rigid wingsail supported by the mast structure, e.g. according to one or more of the other aspects of the invention;

wherein the wingsail is removable from the mast structure;

and wherein the vessel is provided with a crane assembly that is mountable on the mast structure when the wingsail has been removed.

The eight aspect of the invention also relates to a transportation system, said system comprising:

a vessel provided with at least one rigid wingsail installation, said installation comprising a mast structure comprising a foot that is secured to the vessel and a rigid wingsail supported by the mast structure, e.g. according to one or more of the other aspects of the invention, wherein the wingsail is removable from the mast structure;

a crane assembly that is mountable on the mast structure when the wingsail has been removed.

The eight aspect of the invention also relates to a method for providing a vessel having at least one rigid wingsail installation, said vessel having crane capacity, said method comprising the steps of:

providing a vessel with at least one rigid wingsail installation, said installation comprising a mast structure comprising a foot that is secured to the vessel and a rigid wingsail supported by the mast structure, e.g. according to one or more of the other aspects of the invention, removing the wingsail from the mast structure;

mounting a crane assembly on the mast structure when the wingsail has been removed.

The eight aspect of the invention is based on the insight that a mast structure embodied to support a rigid wingsail, e.g. a large sized wingsail, has, or can be designed to have, sufficient strength to act as a mount for a crane assembly.

This eight aspect e.g. allows for a cargo vessel to be operated for some cargo with one or more wingsails, e.g. if no crane capacity for handling of cargo is required, and to be converted into a vessel having crane capacity if the cargo handling so requires. For instances some vessels are operated as bulk cargo vessels to be loaded and/or unloaded by machinery not requiring a crane, e.g. for transportation of grain. These vessels may, e.g. in another period of the year be operated as vessels having crane capacity for transport of other cargo.

So a vessel could be operated for one trip, or one period, with one or more wingsails, and for another trip, or another period, with one or more wingsail installations converted into cranes. One could also envisaged that the conversion to a crane is only done when loading/unloading takes place, the wingsail being mounted again when the vessel is to leave port. The crane assembly could be stored on the vessel, e.g. in a dedicated storage facility, or in a port, e.g. when the vessel is used on a specific route.

It is envisaged that in embodiments not the entire mast structure as used to support the wingsail is maintained when the crane assembly is mounted, but e.g. parts of the "sailing mast structure" can be removed, e.g. a top portion of the sailing mast structure, to accommodate the mounting of the crane assembly. As is preferred at least the lower portion of the sailing mast structure, in particular the foot, are retained to mount the crane assembly thereon.

For example the mast structure, or part of the mast structure, can be embodied as a kingpost for a kingpost crane. In such a known crane design, a revolving crane superstructure is arranged to fit over and revolve around the kingpost.

In an embodiment the crane assembly, e.g. in the above kingpost crane, comprises a boom, as well as hoisting and slewing devices for hoisting a load and for slewing the boom. The crane assembly may also include an crane operator cabin.

With a stationary mast structure, or with a rotary mast structure that is kept stationary during crane operation, preferably multiple vertically spaced radial bearing members are provided to absorb the overturning moment of the crane, as well as at least one axial bearing member to support axial loads. For example a single combined axial and radial bearing assembly is provided at a top end of the mast structure, and at least one radial bearing member is arranged at a lower position.

Preferably two vertically spaced apart radial bearing members are present between the mast structure on the one hand, e.g. the mast structure embodied as a fixed singular column structure, e.g. having a circular cross-section, and the rigid wingsail main panel that revolves around the mast structure on the other hand. In an embodiment there is no provision for a primary tilting assembly. Preferably, an axial bearing member is provided between the lower end of the wingsail main panel and either the foot of the mast structure or the adjacent deck portion of the vessel. For example the axial bearing has one or more spherical raceways with a center of radius on the vertical axis of the mast above the axial bearing member, said spherical design e.g. allowing for some relative tilting of the lower end of the wingsail, e.g. due to deformation of the wingsail installation under load. Preferably the lowermost radial bearing member is vertically spaced from the axial bearing member, e.g. by a distance of twice the mast diameter.

In an embodiment the crane assembly may include a slewable member to be mounted over the mast, e.g. so as to extend around a lower portion of the mast structure, and a pivotable boom pivotally connected to the slewable member. The pivoting of the boom can e.g. be done with one or more hydraulic devices and/or with one or more luffing cable.

The crane assembly may comprise at least one hoisting winch, a hoisting cable, and a load connector, e.g. a crane hook, a grab, etc., the winch being operable to lower and raise the load suspended from or otherwise engaged by the load connector.

For example the mast structure and crane assembly is a kingpost crane system, e.g. as marketed under the name Seatrax.

For example the vessel of the eighth aspect of the invention may have a kingpost member secured to the vessel and a mast top member that is fitted over and rotatable about the kingpost member so as to rotate about a substantially vertical wingsail rotation axis relative to the vessel to adjust the angle of incidence of the wind. When converting to crane capacity the wingsail as well as the mast top member are removed and the crane superstructure is mounted on the kingpost.

In an embodiment the mast top is provided with a primary tilting assembly, and the rigid wingsail comprises:

a rigid wingsail main panel having a lower end, an upper end, a leading edge, and a trailing edge, which rigid wingsail main panel is connected at a position intermediate its lower and upper ends to the mast structure via the primary tilting assembly, the primary tilting assembly allowing for tilting of the rigid wingsail main panel relative to the mast top about a primary tilt axis that is non-parallel, preferably substantially perpendicular, to the vertical wingsail rotation axis.

A ninth aspect of the present invention relates to a vessel provided with at least one rigid wingsail installation, said installation comprising:

a rigid wingsail which is rotatable about a wingsail rotation axis, wherein the wingsail comprises a rigid wingsail panel having a lower end, an upper end, a leading edge, and a trailing edge, said panel having a structure supporting a hard outer skin and forming one or more compartments within the panel.

The rigid wingsail installation may be embodied according to one or more of the other aspects of the invention. For example the installation comprises a mast structure having a mast top, at least the mast top, or e.g. the entire mast, being rotatable about a substantially vertical wingsail rotation axis relative to the vessel to adjust the angle of incidence of the wind. The main panel is connected at a position intermediate its lower and upper ends to the mast structure via the primary tilting assembly, the primary tilting assembly allowing for tilting of the rigid wingsail main panel relative to the mast top about a primary tilt axis that is non-parallel, preferably substantially perpendicular, to a vertical wingsail rotation axis. For example the installation is embodied according to the first aspect of the invention.

As explained herein a very large sized wingsail installation is envisaged, e.g. having a height of 30 meters or more, e.g. more than 50 meters, e.g. between 75 and 120 meters, e.g. serving as auxiliary propulsion for ocean-going commercial vessels.

The ninth aspect of the invention is based on the insight that rigid wingsail installations do not allow for efficient propulsion under some wind conditions, e.g. taken into account the desired course of the vessel and/or wind conditions.

The ninth aspect of the invention therefore proposes a vessel provided with at least one rigid wingsail installation, said installation comprising:

a rigid wingsail which is rotatable about a wingsail rotation axis, wherein the wingsail comprises a rigid wingsail panel having a lower end, an upper end, a leading edge, and a trailing edge, said panel having a structure supporting a hard outer skin and forming one or more compartments within the panel, said vessel being characterized in that the vessel is additionally provided with a kite-sail installation, said kite-sail installation comprising:

a kite-sail, at least one traction cable connecting the kite sail to the vessel so as to transmit traction force to the vessel when the kite-sail is free-flying at an operating altitude, wherein the rigid wingsail panel is provided with a kite-sail storage compartment, said compartment having an opening, preferably at or near the leading edge of the wingsail panel, through the hard outer skin to allow for deployment and recovery of the kite-sail from and back into said storage compartment, one or more movable closure members being provided to close said opening.

Kite-sail installations are known in the art, e.g. from the German company Skysails GmbH. For example the kite-sail is a collapsible textile kite-sail, e.g. one that can be folded in accordion manner for storage.

A kite-sail installation may for example be embodied as described in WO2005100148. A kite-sail installation may include a control pod from which a multitude of steering lines extend to the kite-sail allowing to change the shape of the kite-sail and thereby obtain a controlled spatial motion of the kite-sail. A traction cable extends between the control pod and the vessel.

The presence of the storage compartment for the kite-sail within the rigid wingsail panel allows for reduced deck space usage compared to existing kite-sail installations. Also the deployment and recovery can be easily and safely performed at a significant height above the deck from an elevated launching point, preferably on or near the leading edge of the wingsail panel, thereby avoiding problems with handling of the kite-sail on deck or low above deck.

It is also envisaged that it may be possible to use the wingsail panel as a tool to obtain favorable local wind conditions near the opening for the deployment and recovery of the kite-sail in view of said deployment and recovery, e.g. by adjusting the local wind direction by means of adjusting the angle of the wingsail panel relative to the wind.

Preferably the rigid wingsail panel provided with the kite-sail storage compartment is embodied as the rigid main panel of a wingsail installation according to one or more of the other aspects of the invention.

For example the opening of the storage compartment is provided at the leading edge of the wingsail panel, e.g. with two hinged door panels that are pivotable in opposite directions between a closed position and an opened position. Other closure members, e.g. sliding door panel(s), roller or folding door panels, etc. are also envisaged.

In an embodiment the kite-sail storage compartment is at least 15 meters above the corresponding deck of the vessel.

In an embodiment a kite-sail handling apparatus e.g. a crane having a boom, is provided in said storage compartment adapted, said apparatus being adapted to transfer the kite-sail (in collapsed condition) between a position within the compartment and a position outside of the compartment.

In an embodiment a traction cable winch for said at least one traction cable is provided in the rigid wingsail panel that is provided with said storage compartment. This further reduces deck space usage compared to an embodiment wherein said winch is located on deck of the vessel as is done in prior art installations.

The ninth aspect of the invention also relates to a method of operation the vessel, wherein for deployment of the kite-sail the storage compartment is opened, the kite-sail is removed from the compartment in collapsed condition, e.g. folded like an accordion, wherein the kite is then unfurled or otherwise expanded to be ready for launch, and wherein then the one or more traction cables are paid out until the kite-sail has reached operation altitude. For recovery of the kite-sail the one or more traction cables are pulled in, the kite-sail is reefed into its collapsed condition, and the kite-sail is brought back into the storage compartment.

It will be appreciated that a vessel may comprise any combination of the aspects mentioned above. It will also be appreciated that a vessel according to any of the mentioned aspects may include one or more features or optional features that have been discussed herein in the context of one or more other aspects of the invention.

A vessel may have multiple wingsail installations. For example a cargo vessel may have two rows of wingsail installations, with one or more cargo holds, possibly with hatches, centrally between the wingsail installations.

In a vessel with multiple wingsail installations one can envisage that a limited number of said wingsail installations, e.g. just one or one near each cargo hold, is convertible or transformable into a crane as disclosed herein.

The present invention also relates to a method for transportation with a vessel, wherein use is made of a vessel according to one or more of the mentioned aspects of the invention.

The present invention also relates to a method for transportation with a vessel, wherein use is made of a vessel according to one or more of the mentioned aspects of the invention and wherein the one or more wingsails are brought into a docking position as disclosed herein.

The present invention also relates to a wingsail installation as disclosed herein adapted to be mounted on a vessel.

The invention will now be explained in more detail with reference to the drawings. In the drawings.

Figure 12A:
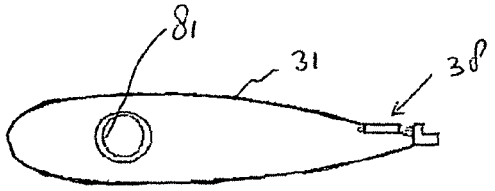
Figure 12B:
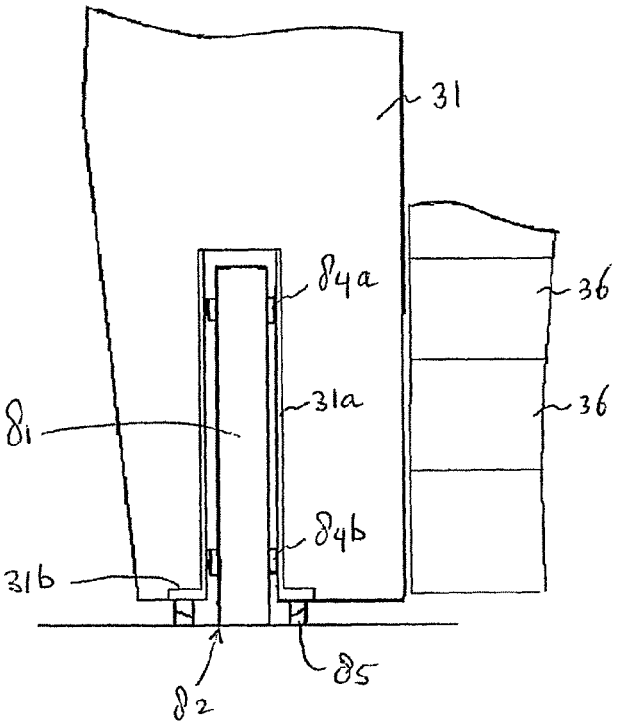
Figure 12C:
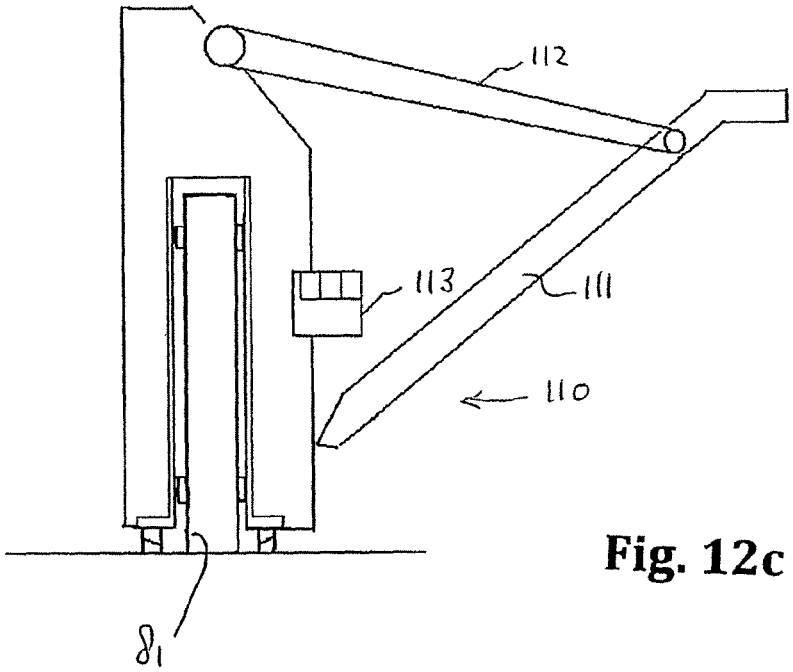

FIGS. 12*a* and *b* show schematically an alternative embodiment of a wingsail installation according to the invention;

FIG. 12*c* schematically illustrates the eighth aspect of the invention;

FIGS. 13*a* and *b* show schematically a part of a rigid wingsail installation provided with a storage compartment for a kite-sail.

With reference to FIGS. 1-10 now an exemplary embodiment of a vessel and rigid wingsail installation according to the invention will be described. On the basis of this embodiment the first aspect of the invention as well as the second to ninth aspects of the invention will be elucidated. The embodiment illustrates that aspects of the invention may well be used in all sorts of combinations, as well as illustrates that preferred or optional features of the first aspect of the invention may be readily combined with any of the other aspects of the invention.

Figure 1:
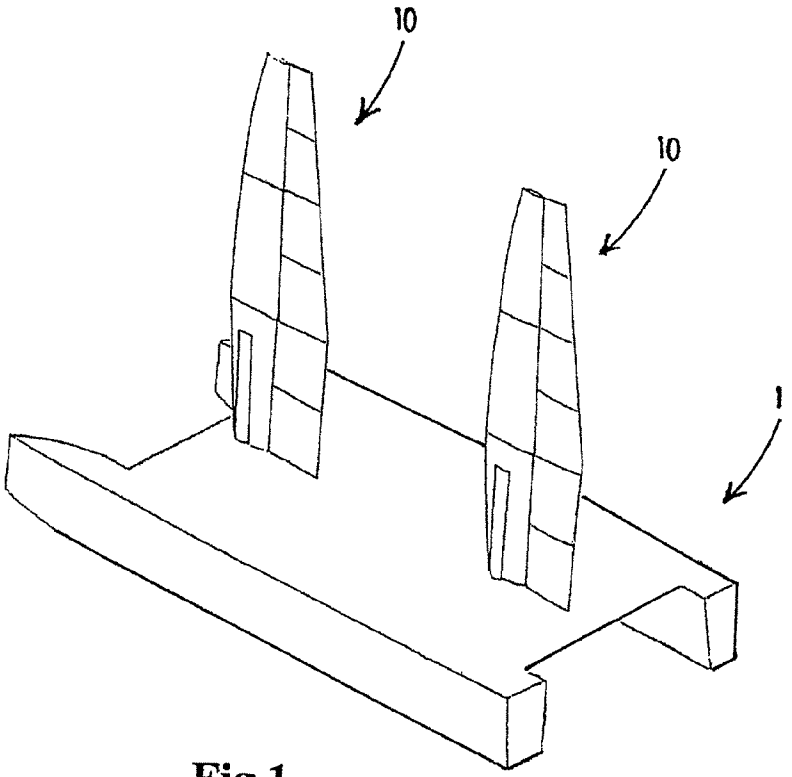
FIG. 1 shows schematically an example of a vessel according to the invention.

The FIG. 1 shows a vessel 1, here—by way of example—a catamaran vessel. The vessel may also be a monohull vessel.

The vessel 1 is an ocean-going vessel, e.g. having a hull length of 135 meters or more.

The vessel 1 is provided with two generally similar rigid wingsail installations 10 with very large sized wingsails, which will be described in more detail below.

As is preferred the rigid wingsail installations are positioned along a longitudinal line over the hull of the vessel, e.g. a midline of the vessel. Other arrangements, e.g. in two rows along respective sides of the vessel, are also possible.

The one or more wingsail installations can be mounted on top of a superstructure of the vessel, e.g. in a cruise liner or ferry.

In general the wingsail installation comprises a mast structure 15 and a rigid wingsail 30 that is supported by the mast structure.

The mast structure 15 comprises a foot 16 that is secured to the vessel and a mast top 17.

In this example the mast structure is a singular column structure embodied as a tubular mast with a substantially closed outer wall. The mast has a diameter of about 2.5 meters and here is circular in cross-section.

The foot 16 of the mast 15 is rotatably connected to the vessel so as to allow for rotation about a non-variable vertical mast rotation axis. The mast, here including its mast top 17, is rotatable about wingsail rotation axis relative to the vessel to adjust the angle of incidence of the wind on the wingsail, at least on the main panel thereof. To perform controlled rotation of the mast a motorized drive 19 is provided, e.g. including a motor and a transmission, e.g. a gear box.

It is envisaged that in excessive wind conditions the mast is allowed to freely rotate, possibly with some damping, in order to allow the wingsail to weathervane.

When sailing is done the mast is rotated to obtain the desired propulsion by means of the wingsail.

At the top end of the mast 15 a primary tilting assembly 20 is provided as will be explained in more detail below.

The rigid wingsail 30 comprises a rigid wingsail main panel 31 having a lower end, an upper end, a leading edge, and a trailing edge. This main panel 31 is connected at a position intermediate its lower and upper ends, preferably about halfway its height, to the mast structure via the primary tilting assembly 20.

The primary tilting assembly allows for tilting of the main panel 31 and all wingsail parts connected thereto relative to the mast top about a primary tilt axis 21 that is substantially perpendicular to the vertical wingsail rotation axis.

The wingsail 30 also comprises a rigid wingsail top panel 35 having a lower end, an upper end, a leading edge, and a trailing edge. The top panel 35 is connected at its lower end to the upper end of the main panel 31 via a secondary tilting assembly 40.

The secondary tilting assembly 40 allows for the tilting of the top panel 35 relative to the main panel 31 about a secondary tilting axis 41 that is substantially perpendicular to the vertical wingsail rotation axis, here parallel to the primary tilt axis 21.

In the depicted embodiment the first tilt axis 21 is arranged at approximately ⅓ of the total height of the wingsail 10 and the second tilt axis 41 at about ⅔ of the total height of the wingsail 10.

Figure 2:
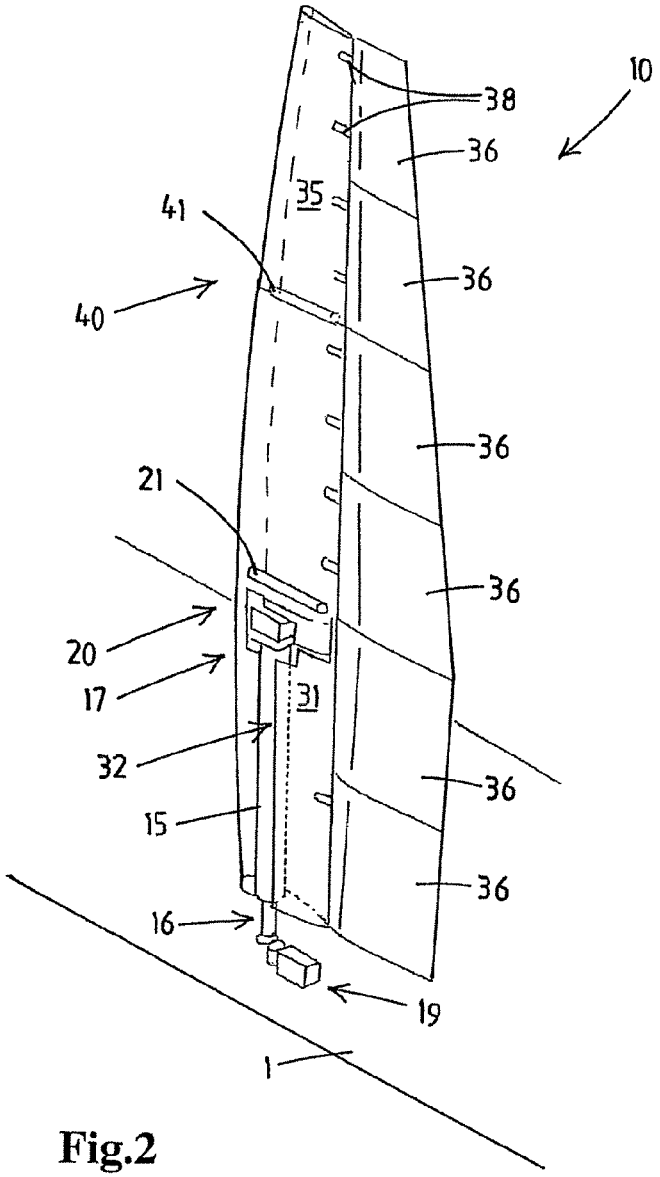
FIG. 2 shows schematically in more detail a wingsail installation of the vessel of FIG. 1 in its erected sailing position.

It can be seen that the main panel 31 is provided with an elongated mast structure receiving recess 32 wherein the mast 15 is received when the main panel 31 is in its vertically erected sailing position (see FIGS. 1, 2). This enhances the streamline and thereby efficiency of the wingsail.

In the depicted embodiment it can also be seen that both the main panel 31 and the top panel 35 are provided at their rear end with at least one wingsail trailing flap element 36, here each with multiple trailing flap elements. Each trailing flap element 36 is pivotally connected to the wingsail main panel or top panel via a pivot assembly allowing to vary the angle of the trailing flap element, e.g. about a substantially vertical pivot axis.

As is preferred each trailing flap element is an airfoil sectioned flap, e.g. with horizontal frame members and vertical frame members, said frame members supporting a hard skin.

For each pivotable trailing flap elements one or more associated power actuators 38 are provided, e.g. one or more hydraulic jacks, to perform the pivoting of each flap into the desired position.

Figure 3:
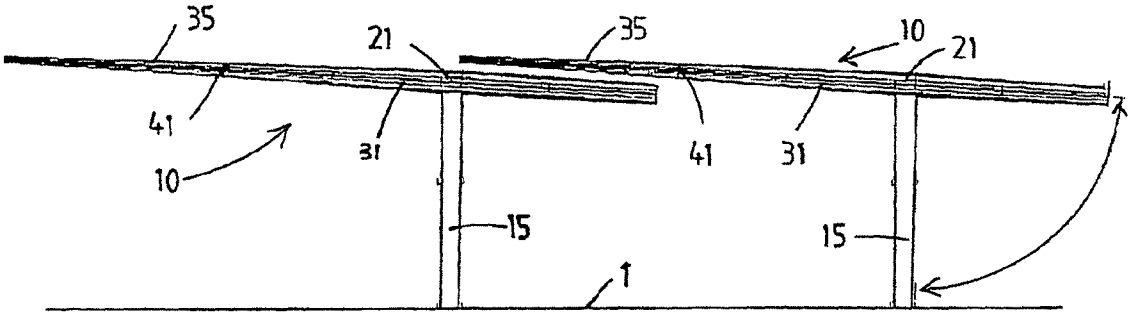
FIG. 3 shows schematically in side view the wingsail installations of the vessel of FIG. 1 in a first docking position.
Figure 4:
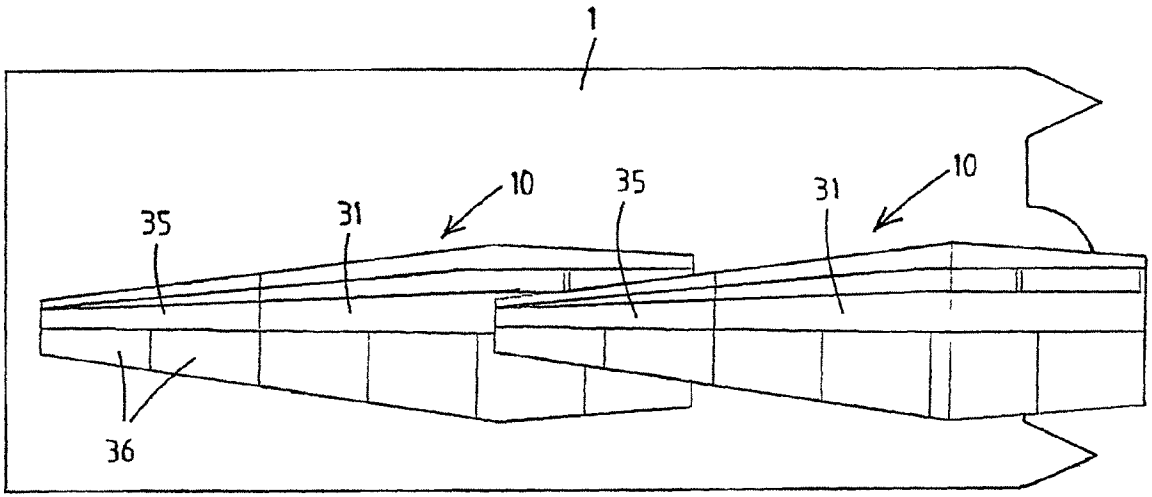
FIG. 4 shows schematically the vessel of FIG. 3 from above.

The wingsail installation is adapted to bring the wingsails 10 in a first docking position as is illustrated in FIGS. 3 and 4. In this docking position a wingsail 10, with its top panel 35 still aligned with the corresponding main panel 31, is brought into an overlapping position with the other wingsail 10, so that one wingsail lies with a top portion thereof above the lower portion of the other wingsail. It is also possible to arrange said top portion below the other wingsail if desired. The overlap can be clearly recognized in FIGS. 3 and 4.

To fasten the wingsails in this docking position one can envisage the use of a temporary securing assembly in the region of overlap of the wingsails, allowing to secure the wingsails to each other. For example such an assembly is mounted on the underlying wingsail prior to the tilting procedure, or is even integrated in the wingsail and operated to be extended from the wingsail for operational use.

The FIGS. 3 and 4 illustrate that the main panel is tilted to an approximate horizontal position, spaced above the deck of the vessel by the effective height of the mast 15.

Figure 5:
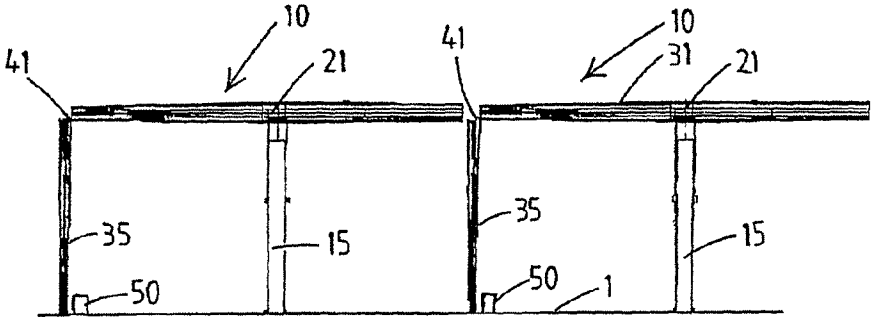
FIG. 5 shows schematically in side view the wingsail installations of the vessel of FIG. 1 in a second docking position.
Figure 6:
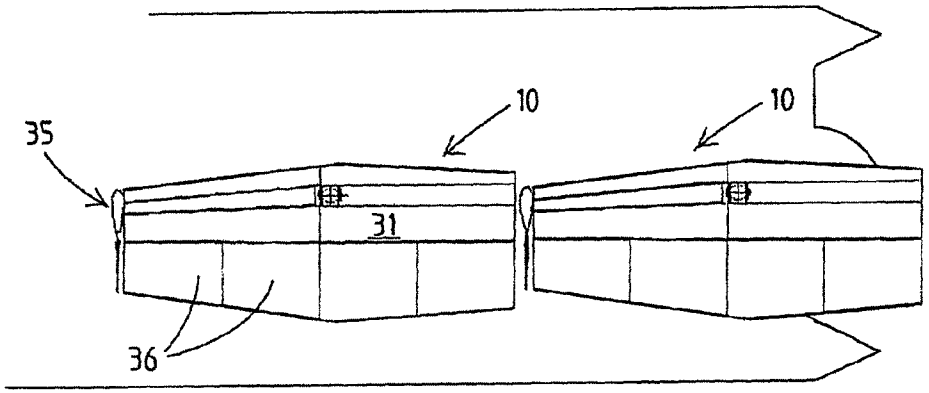
FIG. 6 shows schematically the vessel of FIG. 5 from above.
Figure 7:
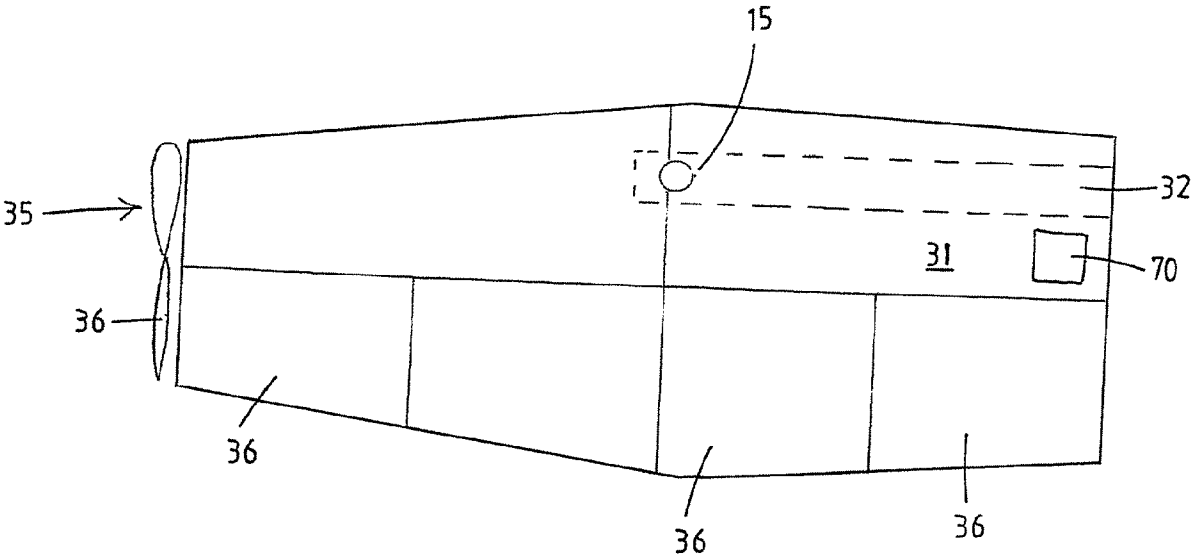
FIG. 7 shows schematically a single wingsail installation of FIG. 5.

The FIGS. 5, 6 and 7 illustrate a more preferred docking situation, wherein the top panel 35 of one or more, here both, wingsails is folded downward relative to the substantially horizontally arranged main panel 31. The respective wingsail parts are dimensioned in combination with the spacing between the masts 15 that there is no horizontal overlap between the wingsails in the docking situation.

As schematically depicted in this preferred docking situation the top end reaches down to the vessel. Here, at 50, the vessel comprises a docking position securing assembly that is adapted to engage on the top panel 35 in its downward oriented docking position, with the main panel substantially horizontal 31, and to secure said top panel 35 relative to the vessel.

As is preferred the top end of the top panel 35 in its downward oriented docking position can be reached by maintenance crew members, e.g. to perform maintenance on equipment on the top of the wingsail such as radar and telecommunication equipment.

Figure 8:
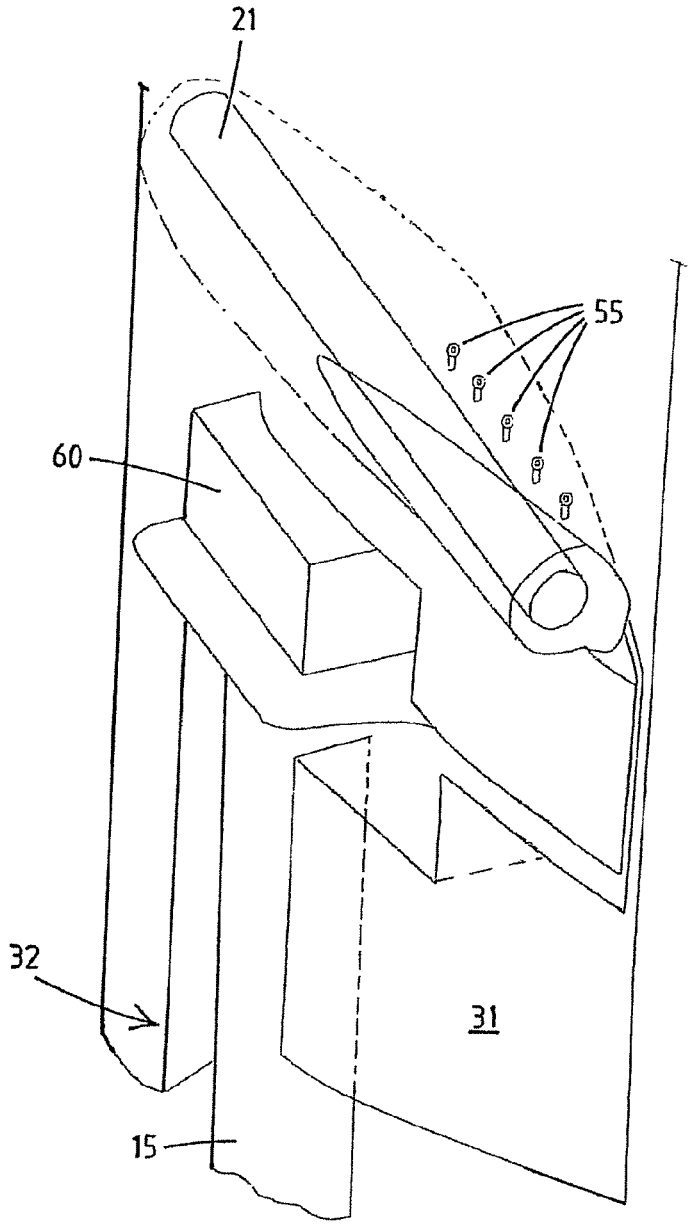
FIG. 8 shows schematically the wingsail of FIGS. 1 and 2 near the top end of the mast.

FIG. 8 schematically illustrates an embodiment of the arrangement at the top end of the mast 15. The mast top end supports a robust shaft 21 that forms the tilt axis in this embodiment. The shaft 21 is horizontally arranged and follows the rotation of the mast top end, here of the entire mast 15. Instead of a shaft 21 other hinge or pivoting structures may be provided.

This primary tilting assembly 20 is associated with one or more power drive motors arranged between the mast top and the main panel, here a row of multiple hydraulic jacks 55, to provide tilting force for performing the tilting of the wingsail about the primary tilt axis 21. Only the connectors of these jacks are depicted in FIGS. 8 and 9.

It is noted that the secondary tilting assembly 40 can be embodied similar to the primary tilting assembly, e.g. also one or more power drive motors arranged between the main panel and the top panel, e.g. one or more hydraulic jacks, to provide tilting force for performing the tilting of the top panel 35 about the secondary tilt axis 41.

In this embodiment it is depicted that a hydraulic group 60 is provided including a motor driven hydraulic pump, a reservoir for hydraulic fluid, and a hydraulic circuit, said hydraulic group being connected to one or more hydraulic jacks arranged between the mast top and the main panel, and/or between the main panel and the top panel. In this embodiment the group is arranged at the top end of the mast, however a location near the foot of the mast or within the foot of the mast, is more preferred.

Figure 9:
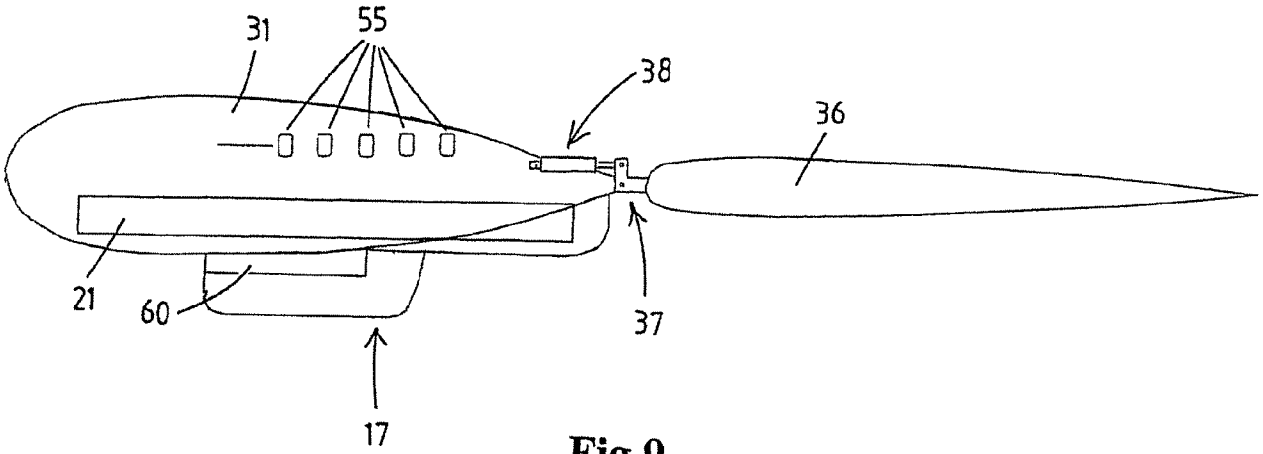
FIG. 9 shows schematically in horizontal cross-section the wingsail of FIGS. 1 and 2 at the first tilting axis.
Figure 10:
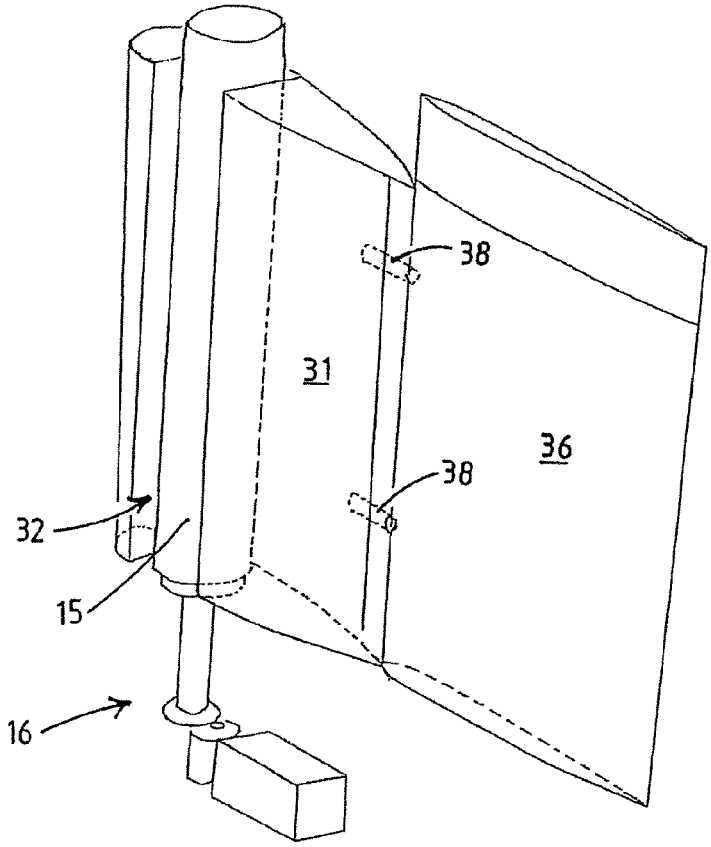
FIG. 10 shows schematically the wingsail installation of FIGS. 1 and 2 near the foot of the mast structure.

FIGS. 8 and 9 illustrate, as is preferred, that the tilting shaft 21 is arranged parallel to and horizontally offset from a vertical midplane of the wingsail, for example between 1 and 2 meters offset. This allows to create ample space for the power motors to be housed within the contour of the main panel yet next to the shaft 21 and to obtain a favorable moment arm between the axis 21 and said power motors 55.

It is illustrated that the tilting shaft 21 is offset horizontally such that a portion of the shaft extends outside the contour of the main panel. A bulbous, e.g. streamlined, cover is provided on said panel to cover the extending portion of the tilting shaft.

In an embodiment not shown in more detail the rigid wing sail comprises a bottom panel that is connected at its upper end to the lower end of the rigid sail main panel via a tertiary tilting assembly, the tertiary tilting assembly allowing for tilting of the rigid wingsail bottom panel relative to the rigid wingsail main panel about a tertiary tilting axis that is non-parallel, preferably substantially perpendicular, to the vertical wingsail rotation axis, more preferably parallel to the primary tilt axis.

It is envisaged that the rigid wing sail is provided with one or more internally arranged tilting procedure ballast water balancing tanks, e.g. at 70 as depicted in FIG. 7. The installation then may comprise a wingsail balancing system comprising one or more water pumps and a water circuit connecting to said one or more balancing tanks allowing to control and vary the amount of water in said balancing tanks, e.g. by pumping seawater into and out of the tanks 70.

As explained the wingsails 10 are envisaged to be of very large size, e.g. having a total height of 50 meters or more, e.g. of 85 meters or more measured from the lowermost end to the uppermost end of the wingsail.

The airfoil body of the main panel may have a thickness in the range of several meters, e.g. about 4 meters, with the mast having a diameter of 3.5 meters. The weight of the wingsail may well be several hundreds of tonnes, e.g. between 300 and 600 tonnes.

The height of the mast in the depicted embodiment may lie in the range between 35 and 45 meters.

In order to allow for access of crew members or others to the mast top and higher up, it is envisaged that in an embodiment the mast structure is provided with a first personnel or material elevator comprising an elevator cage and a motorized hoisting device for said elevator case, said first elevator extending over at least a major part of the height of the mast. Optionally the wing sail main panel is provided with a second personnel or material elevator comprising an elevator cage and a motorized hoisting device for said elevator case, said elevator extending over at least a major part of the height of the main panel.

Figure 11:
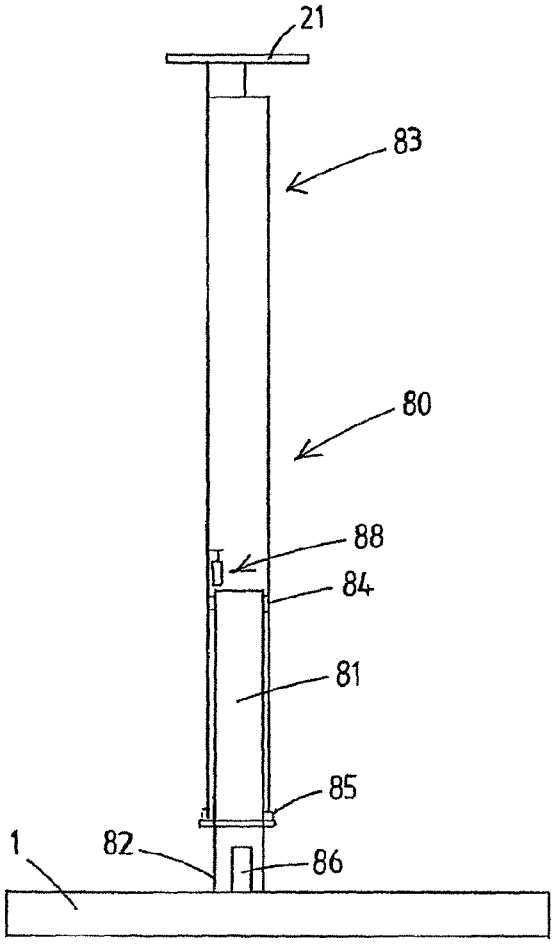
FIG. 11 shows schematically an alternative embodiment of the mast structure.

FIG. 11 illustrates an alternative embodiment of the mast structure 80. A fixed column 81 has its foot 82 fixed to the vessel 1. A top end member 83 is rotatably mounted on the fixed column 81 so as to allow for rotation about the mast rotation axis. The top end member is provided with the primary tilting assembly, here depicted as shaft 21.

Between the fixed column 81 and the member 83 one or more bearings are arranged, here a radial bearing 84 near the top of the column 81 and a radial and axial bearing 85 near the lower end of member 83.

Reference numeral 86 denotes an access door for crew members into the mast, e.g. to provide access to an elevator and/or a stairwell in the mast structure 80. Rotation of the mast top end member 83 may be effected by a motorized drive, schematically depicted at 88. This drive may be arranged below deck if desired, or in the mast or mast foot.

The skilled person will appreciate that in an embodiment the fixed column 81 can serve as a mount for a crane assembly, e.g. as a kingpost, as discussed above with reference to the eighth aspects of the invention. When converting to crane capacity the wingsail as well as the member 83 are removed and the crane revolving superstructure is mounted on the column 81.

FIG. 12*c* schematically illustrates the removal of the wingsail from the mast structure and the mounting of a crane revolving superstructure 110 on the column 81. Here, as is preferred, the crane 110 comprises a boom 111, hoisting device with hoisting cables 112 and one or more winches (not shown), a slewing device (not shown. e.g. with one or more motor driven pinions engaging on a toothed ring at a lower end of the column 81 or on deck), and an operator cabin 113.

In another embodiment the member 83 is not removed from the column 81, for example—after removal of the wingsail—a crane boom being pivotally attached to the member 83. The crane boom can form part of a superstructure including one or more winches, cables, and operator cabin.

FIGS. 12*a* and 12*b* schematically illustrate, in horizontal cross-section and in side view, an example of a rigid wingsail installation according to the eighth aspect of the invention.

The mast structure comprises a fixed column 81 that has its foot 82 fixedly secured in a non rotatable manner to the vessel 1. There is no provision of a mast top end member with primary tilting assembly in this example. It is illustrated, by way of example, that the wingsail with main panel 31 can merely revolve about the column 81 with no tilting capability about a primary tilting axis as disclosed herein. A top panel can be provided as disclosed herein if desired.

FIG. 12*b* illustrates that two vertically spaced apart radial bearing members 84*a*, 84*b* are present between the mast structure, here column 81, on the one hand and the rigid wingsail main panel 31 that revolves around the mast structure on the other hand. Preferably said vertical spacing is at least 10 meters, e.g. at least 20 meters.

An axial bearing member 85 is provided between the lower end of the wingsail main panel 31, e.g. engaging a lower end frame member of the main panel, and the adjacent deck portion of the vessel. For example the axial bearing member 85 is an axial spherical bearing member having one or more raceways, e.g. for rollers, at an angle with respect to the bearing axis. An axial spherical bearing at said location is preferred in combination with said vertically spaced apart radial bearing members 84*a,b* as the bearing member 85 allows to compensate to some degree for misalignments and deflections or deformations. Preferably the lowermost radial bearing member 84*b* is vertically spaced from the axial bearing member 85, e.g. by a distance of at least once, preferably at least twice the column diameter of column 81.

For example the main panel 31 may include a tubular member 31*a* that is integral with the frame structure of the main panel 31, wherein the radial bearing members are arranged between said member 31*a* and the column 81. The tubular member 31*a* may have a lower, outwardly directed base 31*b* on which the axial bearing member 85 engages.

If desired the wingsail may be removable from the column 81 in order to allow the mounting of a revolving crane 110 as illustrated in FIG. 12*c*. The crane 110 may be rotatably supported by a similar bearing arrangement as the wingsail relative to the column, e.g. with two radial bearings 84*a,b* at the same elevational positions as the wingsail and on the axial bearing 85 on the deck.

FIG. 13*a, b* illustrate schematically a part of a rigid wingsail installation provided with a storage compartment for a kite-sail.

The FIG. 13*a, b* show in horizontal cross-section and in side-view a part of rigid main panel 31 as well as of trailing flaps 36. The mast is shown as 15, here in recess 32 as the wingsail is in sailing position.

The main panel 31 has a structure supporting a hard outer skin having an aerofoil outer contour and forming one or more compartments within the panel 31. For example the structure comprises horizontal frame members interconnected vertically, e.g. by panels, beam, etc.

According to the ninth aspect of the invention the vessel not only has one (or more) rigid wingsail installations, but also at least one kite-sail installation, said kite-sail installation comprising:

a kite-sail 95 (only schematically shown in collapsed storage condition), at least one traction cable 96 connecting the kite sail to the vessel so as to transmit traction force to the vessel when the kite-sail is free-flying at an operating altitude.

The panel 31 is provided with a kite-sail storage compartment 97. If the vessel has multiple wingsail installations it is preferred that the most forward wingsail installation is provided with a kite-sail storage compartment.

The compartment 97 has an opening 98 at or near the leading edge of the wingsail panel 31 through the hard outer skin to allow for deployment and recovery of the kite-sail 95 from and back into the storage compartment 97. One or more movable closure members, e.g. two hinged door panels 99, are being provided to close opening when the kite-sail is stored or possibly also when the kite-sail is deployed.

The opening 98 of the storage compartment 97 is provided here at the leading edge of the wingsail panel, in this example with two doors that are movable, here pivotable, between a closed position and an opened position 99*a* (see horizontal cross-section). Other closure members, preferably adapted to provide a streamlined contour when closed, e.g. sliding door panel(s), roller or folding door panels, etc. are also envisaged for this opening 98.

FIG. 13*b* also illustrates the possibility that the rigid wingsail panel 31 is provided with a kite-sail handling apparatus 102, preferably a motorized handling apparatus, e.g. a hydraulic or electrically operated crane having a boom, which is provided in the storage compartment 97 and is adapted to transfer the kite-sail (in collapsed condition) between a position within the compartment and a position outside of the compartment. Once positioned outside (or at least partly outside) the compartment 97, the kite-sail 95 can be deployed, released from the handling apparatus, and by paying out the traction cable 96 allowed to reach is operational altitude.

The rigid panel 31 may be provided on the inside with stairs and walkways to allow for access of personnel to the storage compartment 97 via the interior of the rigid panel 31, e.g. when first using the elevator as disclosed herein.

In an embodiment the kite-sail storage compartment 97 and opening 98 is at least 15 meters above the corresponding deck of the vessel. Preferably the compartment 97 is below the first tilting axis 21.

The FIG. 13*b* shows that a traction cable winch 100 for the at least one traction cable 96 is provided on or below the deck of the vessel, but a position of the winch 100 within the panel 31 or in the mast 90 is also envisaged.

Here, as is a possibility, the cable passes from the winch 100 through the interior of the panel 31 to the opening of the storage compartment 97 and then out to the free-flying kite-sail (the direction of the cable 96 is schematically shown). One or more further deployment and/or recovery cables and winches may be provided on the wingsail to assist in the deployment and recovery of kite-sail, e.g. one cable extending from a sheave 101 above the opening 98 of the compartment 97.

The wingsail installation may be operated, e.g. by adjusting the angle of incidence of the wind, to create airflow conditions that are favorable to the deployment and/or recovery of the kite-sail from and into in the storage compartment 97.

If the kite-sail is provided with a control pod, the pod may also be stored in and deployed from said compartment 97.

The invention claimed is:

1. A vessel provided with at least one rigid wingsail installation, said installation comprising:

a mast structure and a rigid wingsail supported by the mast structure, wherein the mast structure comprises a foot that is secured to the vessel and a mast top, wherein the mast top is rotatable about a substantially vertical wingsail rotation axis relative to the vessel to adjust an angle of incidence of the wind, and wherein the mast top is provided with a primary tilting assembly, wherein the rigid wingsail comprises:

a rigid wingsail main panel having a lower end, an upper end, a leading edge, and a trailing edge, which rigid wingsail main panel is connected at a position intermediate its lower and upper ends thereof to the mast structure via the primary tilting assembly, the primary tilting assembly allowing for tilting of the rigid wingsail main panel relative to the mast top about a primary tilt axis that is non-parallel to the vertical wingsail rotation axis, a rigid wingsail top panel having a lower end, an upper end, a leading edge, and a trailing edge, which rigid wingsail top panel is connected at its a lower end thereof to the upper end of the rigid wingsail main panel via a secondary tilting assembly, the secondary tilting assembly allowing for tilting of the rigid wingsail top panel relative to the rigid wingsail main panel about a secondary tilt axis that is non-parallel to the vertical wingsail rotation axis.

2. Vessel according to claim 1, wherein the main panel is provided with an elongated mast structure receiving recess wherein the mast structure is received when the main panel is in its a vertically erected sailing position.

3. Vessel according to claim 1, wherein the wingsail installation is adapted to bring the wingsail in a docking position, wherein the main panel is substantially horizontal and the top panel is oriented downwards.

4. Vessel according to claim 3, wherein the vessel comprises a docking position securing assembly that is adapted to engage on the top panel in a downward oriented docking position thereof, with the main panel substantially horizontal, and to secure said top panel relative to the vessel.

5. Vessel according to claim 1, wherein the primary tilting assembly is associated with one or more power drive motors arranged between the mast top and the main panel, e.g. one or more hydraulic jacks, to provide tilting force for performing the tilting of the wingsail about the primary tilt axis.

6. Vessel according to claim 1, wherein the secondary tilting assembly is associated with one or more power drive motors arranged between the main panel and the top panel, e.g. one or more hydraulic jacks, to provide tilting force for performing the tilting of the top panel about the secondary tilt axis.

7. Vessel according to claim 5, wherein a hydraulic group is provided including a motor driven hydraulic pump, a reservoir for hydraulic fluid, and a hydraulic circuit, said hydraulic group being connected to one or more hydraulic jacks arranged between the mast top and the main panel, or between the main panel and the top panel.

8. Vessel according to claim 1, wherein the first tilting assembly and second tilting assembly each comprises a respective first and second tilting shaft secured to the mast top or to the main panel at an upper end thereof.

9. Vessel according to claim 1, wherein the vessel has at least a first and a second wingsail installation, wherein the mast structures of the first and second wingsail installations are spaced apart by a mast spacing distance, and wherein the first and second wingsail installations allow for a docking position of the first and second wingsails wherein the each of the first and second wingsail installations is tilted so as to be lying with a main panel thereof extending towards the mast structure of the other one of the first and second wingsail installations.

10. Vessel according to claim 9, wherein in said docking position the top panel is folded downward relative to a substantially horizontally arranged main panel.

11. Vessel according to claim 1, wherein the rigid wingsail comprises a bottom panel having a lower end, an upper end, a leading edge, and a trailing edge, which rigid wingsail bottom panel is connected at an upper end thereof to the lower end of the rigid sail main panel via a tertiary tilting assembly, the tertiary tilting assembly allowing for tilting of the rigid wingsail bottom panel relative to the rigid wingsail main panel about a tertiary tilt axis that is non-parallel to the vertical wingsail rotation axis.

12. Vessel according to claim 1, wherein the rigid wingsail is provided with one or more internally arranged tilting procedure ballast water balancing tanks, and wherein the installation comprises a wingsail balancing system comprising one or more water pumps and a water circuit connecting to said one or more balancing tanks allowing to control and vary the amount of water in said balancing tanks.

13. Vessel according to claim 1, wherein the mast structure is provided with a first personnel or material elevator comprising an elevator cage and a motorized hoisting device, said first elevator extending over at least a major part of the height of the mast.

14. Vessel according to claim 1, wherein at least the main panel or the top panel are provided at their rear end with at least one wingsail trailing flap element, said trailing flap element being pivotally connected to the wingsail main panel or top panel via a pivot assembly allowing to vary an angle of the trailing flap element about a pivot axis.

15. Vessel according to claim 1, wherein the wingsail is provided with photovoltaic cells to produce electrical power.

16. Vessel according to claim 1, wherein the mast structure is a singular column structure which comprises a fixed column whereof the foot is fixed to the vessel, and a top end member that is rotatably mounted on the fixed column so as to allow for rotation about the mast rotation axis, and wherein the top end member is provided with the primary tilting assembly.

17. Vessel according to claim 1, wherein the mast structure is telescopic, thereby allowing to vary the distance between the wingsail and the neighboring deck of the vessel.

18. A method for transportation with a vessel, wherein use is made of a vessel according to claim 1.

19. A method for operating a vessel according to claim 18, wherein the at least one wingsail installation is brought in a docking position.

20. The vessel according to claim 1, wherein the primary tilting assembly allows for tilting of the rigid wingsail main panel relative to the mast top about a primary tilt axis that is substantially perpendicular to the vertical wingsail rotation axis.

21. The vessel according to claim 1, wherein the secondary tilting assembly allows for tilting of the rigid wingsail top panel relative to the rigid wingsail main panel about a secondary tilt axis that is substantially perpendicular to the vertical wingsail rotation axis.

22. The vessel according to claim 21, wherein the secondary tilting assembly allows for tilting of the rigid wingsail top panel relative to the rigid wingsail main panel about a secondary tilt axis that is parallel to the primary tilt axis.

23. The vessel according to claim 3, wherein the wingsail installation is adapted to bring the wingsail in a docking position, wherein the main panel is substantially horizontal and the top panel is oriented downwards and substantially vertical.

24. The vessel according to claim 8, wherein the first or second tilting shaft is arranged parallel to and horizontally offset from a vertical midplane of the wingsail.

25. The vessel according to claim 11, wherein the tertiary tilting assembly allows for tilting of the rigid wingsail bottom panel relative to the rigid wingsail main panel about a tertiary tilt axis that is substantially perpendicular to the vertical wingsail rotation axis.

26. The vessel according to claim 11, wherein the tertiary tilting assembly allows for tilting of the rigid wingsail bottom panel relative to the rigid wingsail main panel about a tertiary tilt axis that is parallel to the primary tilt axis.

27. The vessel according to claim 1, wherein the wingsail main panel is provided with a second personnel or material elevator comprising an elevator cage and a motorized hoisting device, said second elevator extending over at least a major part of the height of the main panel.

28. The vessel according to claim 14, wherein the pivot axis is substantially vertical.

29. The vessel according to claim 15, wherein the main panel or the top panel are provided at their rear end with at least one wingsail trailing flap element, said trailing flap element being pivotally connected to the wingsail main panel or top panel via a pivot assembly allowing to vary an angle of the trailing flap element about a pivot axis, and having the photovoltaic cells arranged at least on the trailing flap elements.

* * * * *